US009312638B2

(12) United States Patent
Shimizu et al.

(10) Patent No.: US 9,312,638 B2
(45) Date of Patent: Apr. 12, 2016

(54) LEVER CONNECTOR

(71) Applicant: YAZAKI CORPORATION, Minato-ku, Tokyo (JP)

(72) Inventors: Tomohiko Shimizu, Makinohara (JP); Akinori Tashiro, Makinohara (JP); Akihiro Tsuruta, Fujieda (JP); Kazuya Terao, Fujieda (JP)

(73) Assignee: YAZAKI CORPORATION, Tokyo (JP)

( * ) Notice: Subject to any disclaimer, the term of this patent is extended or adjusted under 35 U.S.C. 154(b) by 112 days.

(21) Appl. No.: 14/139,921

(22) Filed: Dec. 24, 2013

(65) Prior Publication Data

US 2014/0113470 A1 Apr. 24, 2014

Related U.S. Application Data

(63) Continuation of application No. PCT/JP2012/066653, filed on Jun. 29, 2012.

(30) Foreign Application Priority Data

Jul. 1, 2011 (JP) ..... 2011-147153

(51) Int. Cl.
*H01R 13/62* (2006.01)
*H01R 13/64* (2006.01)
(Continued)

(52) U.S. Cl.
CPC ..... *H01R 13/64* (2013.01); *H01R 13/629* (2013.01); *H01R 13/62927* (2013.01); *H01R 13/62955* (2013.01); *H01R 13/641* (2013.01); *H01R 13/74* (2013.01)

(58) Field of Classification Search
CPC ..... H01R 13/641; H01R 13/74; H01R 13/62927; H01R 13/62955
USPC ..... 439/157, 160, 544, 552
See application file for complete search history.

(56) References Cited

U.S. PATENT DOCUMENTS 8,403,697 B2 * 3/2013 Fukamachi et al. ..... 439/157
2011/0143571 A1 6/2011 Fukamachi et al.

FOREIGN PATENT DOCUMENTS

CN 101394042 A 3/2009
JP 2002-359037 A 12/2002
(Continued)

OTHER PUBLICATIONS

Japanese office action letter issued on Jan. 20, 2015 in the counterpart Japanese patent application.
(Continued)

*Primary Examiner* — Felix O Figueroa
(74) *Attorney, Agent, or Firm* — Mots Law, PLLC

(57) ABSTRACT

A lever connector includes a first connector, a second connector and a lever. The lever includes a locking portion provided to be bendable inward and outward with respect to a rotation direction of the lever. The first connector is provided with a locked portion to be locked with the locking portion. The rotation of the lever causes the locking portion to be bent outward with respect to the rotation direction of the lever, and then causes the locking portion to be bent inward with respect to the rotation direction of the lever such that the locked portion is locked with the locking portion. The locking portion is provided with an abutment portion that abuts on an edge part of an attachment hole of a panel when the first connector and the second connector are attached to the attachment hole in the middle of the rotation of the lever.

3 Claims, 6 Drawing Sheets

(51) Int. Cl.

| | |
|---|---|
| ***H01R 13/629*** | (2006.01) |
| ***H01R 13/641*** | (2006.01) |
| ***H01R 13/74*** | (2006.01) |

(56) References Cited

FOREIGN PATENT DOCUMENTS

| | | | |
|---|---|---|---|
| JP | 2008-027787 | A | 2/2008 |
| JP | 2009-135071 | A | 6/2009 |
| JP | 2011-081951 | A | 4/2011 |
| JP | 2011-124057 | A | 6/2011 |

OTHER PUBLICATIONS

Korean office action letter issued on Apr. 3, 2015 in the counterpart Korean patent application.
Chinese office action letter issued on Jul. 13, 2015 in the counterpart Chinese patent application.

* cited by examiner

LEVER CONNECTOR

CROSS REFERENCE TO RELATED APPLICATION

This is a continuation application based on PCT application No. PCT/JP2012/066653 filed on Jun. 29, 2012, which claims the benefit of priority from Japanese Patent Application No. 2011-147153 filed on Jul. 1, 2011, the entire contents of which are incorporated by reference herein.

BACKGROUND OF THE INVENTION

1. Field of the Invention

The present invention relates to a lever connector to be attached to a panel.

2. Description of the Related Art

A conventional lever connector to be attached to a panel includes a first connector, a second connector to be fitted with the first connector, and a lever which is provided to the first connector and causes the first connector and the second connector to be fitted with each other by rotation thereof. The lever connector is attached to an attachment hole of the panel in a state where the first and the second connectors are fitted with each other (for example, see Patent Literature 1: Japanese Patent Application Laid-Open Publication No. 2002-359037).

In such a lever connector, the lever is formed with an interference portion which does not interfere with a hole edge of the attachment hole of the panel when both connectors have a normal fitted state and interferes with the hole edge of the attachment hole when both connectors have a partial fitted state. The interference portion makes it possible, in a process of attaching both connectors to the attachment hole of the panel, to detect a fitted state of both connectors by determining whether or not the interference portion interferes with the hole edge of the attachment hole.

However, in the above-described lever connector, since the interference portion is formed on the side surface which is located at the rear surface side in the rotation direction of the lever, a degree of interference between the interference portion and the hole edge of the attachment hole becomes small when the lever approaches a horizontal direction with respect to a direction in which the connectors are fitted with each other. This makes it difficult to detect the partial fitted state even if both connectors actually have the partial fitted state. In addition, in order to improve the detection of the partial fitted state, it is considered to extend the interference portion outward with respect to the rotation direction of the lever. However, this has a possibility that the lever connector has a large size.

SUMMARY OF THE INVENTION

In view of the above, the present invention has an object to provide a lever connector capable of improving detection of the partial fitted state of connectors while suppressing the increase of the size thereof.

According to an aspect of the present invention, there is provided a lever connector to be attached to an attachment hole of a panel, including: a first connector; a second connector to be fitted with the first connector; and a lever that is provided to one of the first connector and the second connector and causes the first connector and the second connector to be fitted with each other by rotation thereof, wherein the lever connector is attached to the attachment hole of the panel in a state where the first connector and the second connector are fitted with each other, the lever includes a locking portion that is provided to be bendable inward and outward with respect to a rotation direction of the lever, the one of the first connector and the second connector includes a locked portion that is to be locked with the locking portion, wherein the rotation of the lever causes the locking portion to be bent outward with respect to the rotation direction of the lever, and then causes the locking portion to be bent inward with respect to the rotation direction of the lever in a normal fitted state of the first connector and the second connector such that the locked portion is locked with the locking portion, and the locking portion is provided with an abutment portion that abuts on an edge part of the attachment hole when the first connector and the second connector are attached to the attachment hole of the panel in the middle of the rotation of the lever.

In the lever connector, the lever includes the locking portion that is provided to be bendable inward and outward with respect to the rotation direction of the lever, and one of the connectors includes the locked portion that is to be locked with the locking portion, wherein the rotation of the lever causes the locking portion to be bent outward with respect to the rotation direction of the lever and then causes the locking portion to be bent inward with respect to the rotation direction of the lever in the normal fitted state of the first connector and the second connector such that the locked portion is locked with the locking portion. This prevents increase in the size of the lever connector because a portion which extends outward with respect to the rotation direction of the lever in the partial fitted state of the connectors is only the locking portion which is bent by the locked portion.

The locking portion is provided with the abutment portion that abuts on the edge part of the attachment hole when the first connector and the second connector are attached to the attachment hole of the panel in the middle of the rotation of the lever. The locking portion is not bent inward with respect to the rotation direction of the lever until the connectors are brought into the normal fitted state. Thereby, the abutment portion of the locking portion which is bent outward with respect to the rotation direction of the lever abuts on the edge part of the attachment hole even though the lever approaches the horizontal direction with respect to the fitting direction of the connectors. Thus, it is possible to detect the partial fitted state of the connectors.

Therefore, in the lever connector, it is possible to improve the detection of the partial fitted state of the connectors while suppressing the increase of the size thereof.

According to an aspect of the present invention, the one of the connectors is provided with an abutment enhancement portion that abuts on the edge part of the attachment hole when the abutment portion abuts on the edge part of the attachment hole.

In the lever connector, one of the connectors is provided with the abutment enhancement portion that abuts on the edge part of the attachment hole when the abutment portion abuts on the edge part of the attachment hole. Thereby, in addition to the detection of the partial fitted state of the connectors by the abutment portion, it is possible to detect the partial fitted state of the connectors by the abutment of the abutment enhancement portion on the edge part of the attachment hole. Thus, it is possible to further improve the detection of the partial fitted state of the connectors.

According to an aspect of the present invention, the one of the connectors is provided with the regulation portion that regulates bending of the locking portion outward with respect to the rotation direction of the lever in the normal fitted state of the first connector and the second connector.

In the lever connector, one of the connectors is provided with the regulation portion that regulates bending of the locking portion outward with respect to the rotation direction of the lever in the normal fitted state of the first connector and the second connector. Since the regulation portion prevents release of the locking of the locking portion and the locked portion, it is possible to keep the normal fitted state of the connectors.

According to the present invention, it is possible to provide a lever connector capable of improving detection of a partial fitted state of connectors while suppressing the increase of the size thereof.

DESCRIPTION OF THE EMBODIMENTS

Figure 1:
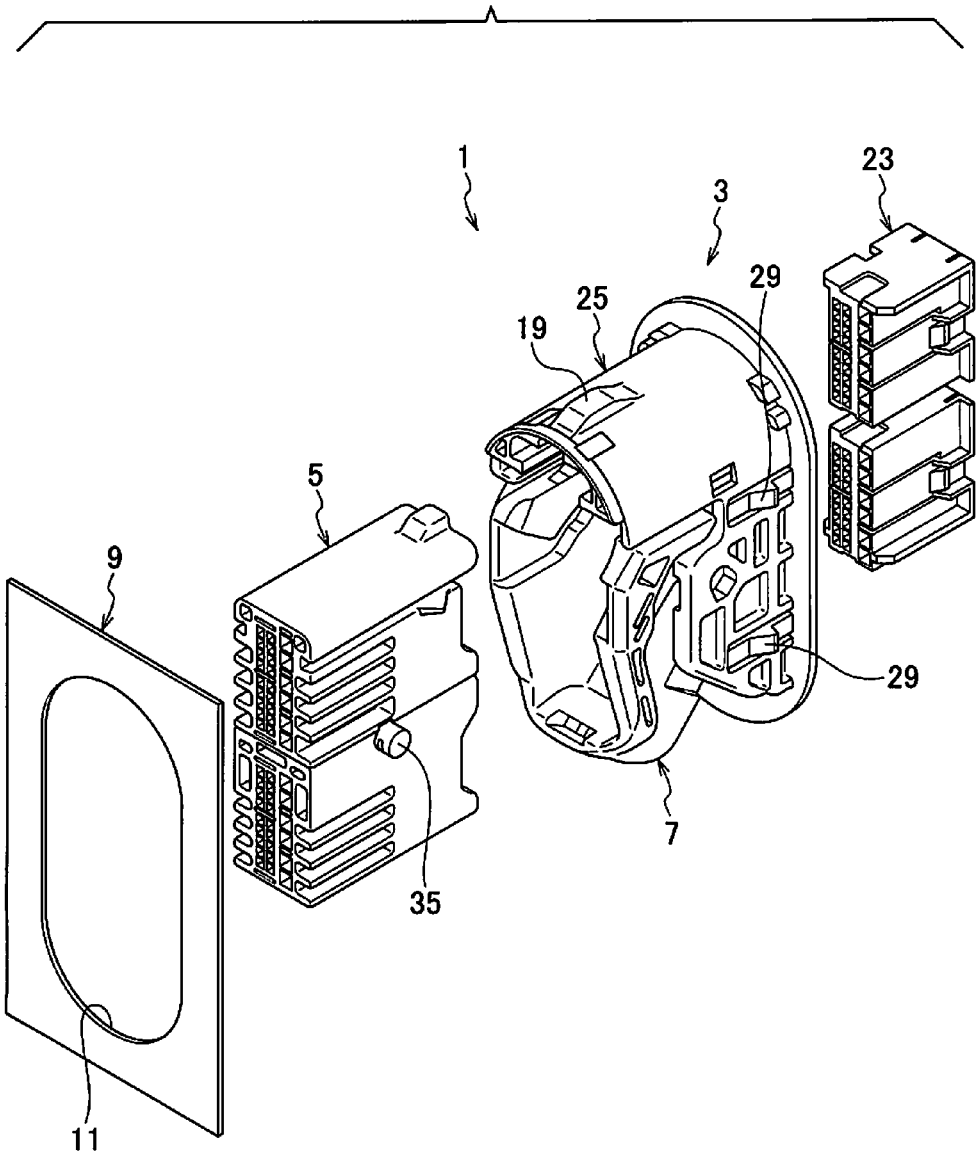
FIG. 1 is an exploded perspective view of a lever connector according to an exemplary embodiment of the present invention.
Figure 2A:
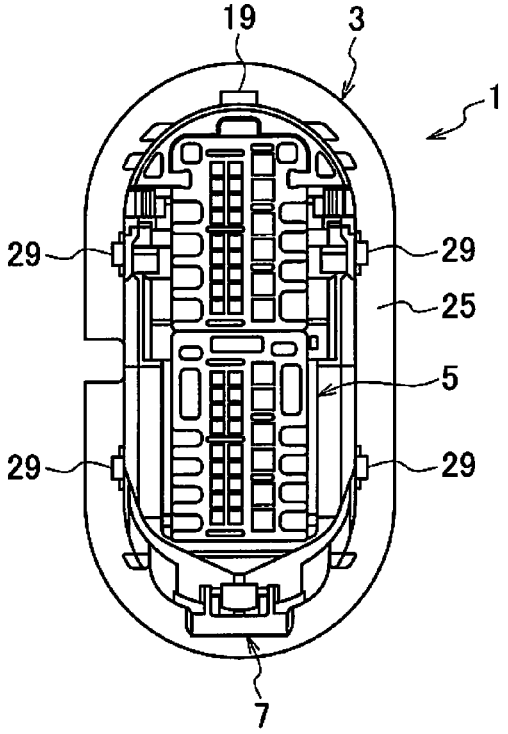
FIG. 2A is a front view of the lever connector according to the exemplary embodiment of the present invention.
Figure 2B:
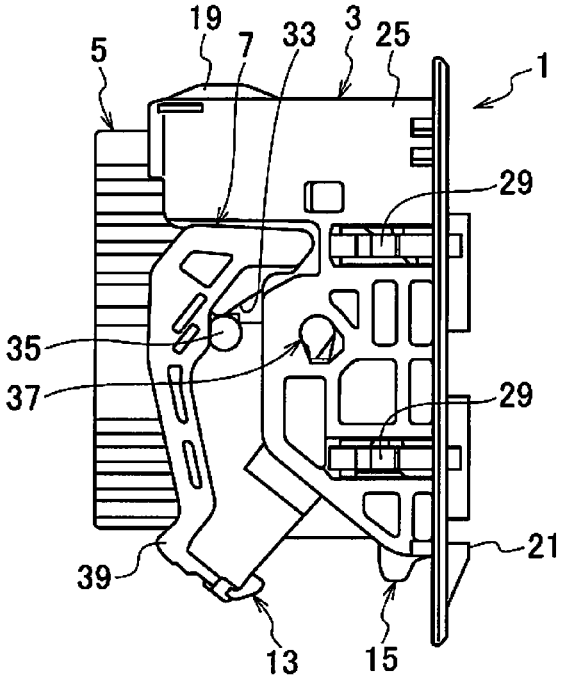
FIG. 2B is a side view of the lever connector according to the exemplary embodiment of the present invention.

A lever connector according to an exemplary embodiment of the present invention will be described using FIGS. 1 to 6B.

A lever connector 1 according to the present embodiment includes a first connector 3, a second connector 5 to be fitted with the first connector 3, and a lever 7 which is provided to the first connector 3 and causes the first connector 3 and the second connector 5 to be fitted with each other by rotation thereof. The lever connector 1 is attached to an attachment hole 11 of a panel 9 in a state where the first connector 3 and the second connector 5 are fitted with each other.

The lever 7 includes a locking portion 13 which is provided to be bendable in an inward direction and an outward direction with respect to a rotation direction of the lever 7. The first connector 3 includes a locked portion 15 which is to be locked with the locking portion 13. The rotation of the lever 7 causes the locking portion 13 to be bent in the outward direction with respect to the rotation direction of the lever 7, and then causes the locking portion 13 to be bent in the inward direction with respect to the rotation direction of the lever 7 in a normal fitted state of the first connector 3 and the second connector 5 such that the locked portion 15 is locked with the locking portion 13.

The locking portion 13 is provided with an abutment portion 17 which abuts on an edge part of the attachment hole 11 when the first connector 3 and the second connector 5 are attached to the attachment hole 11 of the panel 9 in the middle of the rotation of the lever 7.

The first connector 3 is provided with an abutment enhancement portion 19 which abuts on the edge part of the attachment hole 11 when the abutment portion 17 abuts on the edge part of the attachment hole 11.

The first connector 3 is further provided with a regulation portion 21 which regulates bending of the locking portion 13 in the outward direction with respect to the rotation direction of the lever 7 in the normal fitted state of the first connector 3 and the second connector 5.

As shown in FIGS. 1 to 6B, the first connector 3 is composed of an inner housing 23 and a frame 25. The inner housing 23 has a double-decker structure in which two housing members are stacked in a vertical direction, where a plurality of terminals 27 is received inside. The inner housing 23 is received in the frame 25.

The frame 25 receives the inner housing 23 therein and has a plurality of panel locks 29 provided elastically deformable on the outside thereof (at four points here). The panel locks 29 enable the frame 25 to be attached to the attachment hole 11 of the panel 9. The inner housing 23 received in the frame 25 is fitted with the second connector 5 within the frame 25.

The second connector 5 has a double-decker structure in which two housing members are stacked in a vertical direction, which is larger than the inner housing 23, where a plurality of corresponding terminals 31 which is to be connected to the plurality of terminals 27 is received inside. Cam followers 35 to be inserted in cam grooves 33 of the lever 7 are respectively provided in a protruding manner on both side surfaces of the second connector 5. The cam followers 35 are inserted in the cam grooves 33, and then the second connector 5 is fitted with the inner housing 23 by the rotation of the lever 7. Thereby, the plurality of terminals 27 and the plurality of corresponding terminals 31 are connected to each other.

The lever 7 is rotatably mounted to the frame 25 via shaft support parts 37 respectively provided on both side surfaces thereof. The lever 7 is rotated by pressure-operating an operation portion 39 in a state where the cam followers 35 of the second connector 5 are inserted in the cam grooves 33, that is in the partial fitted state of the first connector 3 and the second connector 5. Then, the lever 7 causes the first connector 3 and the second connector 5 to be in the normal fitted state using an action of leverage. The lever 7 includes the locking portion 13 with which the locked portion 15 of the frame 25 is to be locked.

The locking portion 13 is provided on the side of the operation portion 39 of the lever 7 in a manner to be bendable in the inward direction and in the outward direction with respect to the rotation direction of the lever 7. The inward and outward directions with respect to the rotation direction of the lever 7 mean an inward direction and an outward direction with respect to a trajectory drawn by the rotation of the lever 7. That is, the inward direction with respect to the rotation direction is a direction from the trajectory drawn by the rotation of the lever 7 toward the shaft support part 37, and the outward direction with respect to the rotation direction of the lever 7 is a direction from the trajectory drawn by the rotation of the lever 7 toward the outside. The locking portion 13 abuts on the locked portion 15 in the last half of a rotation operation of the lever 7, and then the locking portion 13 is locked with the locked portion 15 at the end of the rotation operation of the lever 7.

The locked portion 15 is provided on the lower surface of the frame 25 in a protruding manner and includes inclined surfaces which incline downward from the top thereof toward both sides. The locked portion 15 bends the locking portion 13 in the outward direction with respect to the rotation direction of the lever 7 when abuts on the locking portion 13 by the rotation operation of the lever 7. When the rotation operation of the lever 7 is further continued from this state, the locking portion 13 gets over the locked portion 15 and is restored in the inward direction with respect to the rotation direction of the lever 7. This allows the locked portion 15 to be locked with the locking portion 13. The locking of the locking portion 13 and the locked portion 15 keeps the normal fitted state of the first connector 3 and the second connector 5.

In the locked state of the locking portion 13 and the locked portion 15, the locking portion 13 is disposed in the regulation portion 21 provided on the frame 25. The regulation portion 21 is provided on the frame 25 in a manner to surround the locking portion 13. Thereby, even if the locking portion 13 is bent in the outward direction with respect to the rotation direction of the lever 7 by an unexpected external force, the regulation portion 21 abuts on the locking portion 13 so as to prevent release of the locking of the locking portion 13 and the locked portion 15. The locking portion 13 is provided with the abutment portion 17.

The abutment portion 17 is a side surface of the locking portion 13 on the side of the outward direction with respect to the rotation direction of the lever 7. The abutment portion 17 abuts on the edge part of the attachment hole 11 when the first connector 3 and the second connector 5 are attached to the attachment hole 11 of the panel 9 in the middle of the rotation of the lever 7 in the partial fitted state prior to the normal fitted state of the first connector 3 and the second connector 5. The frame 25 is provided with the abutment enhancement portion 19 on the upper surface thereof in a protruding manner, which abuts on the edge part of the attachment hole 11 when the abutment portion 17 abuts on the edge part of the attachment hole 11.

Figure 3A:
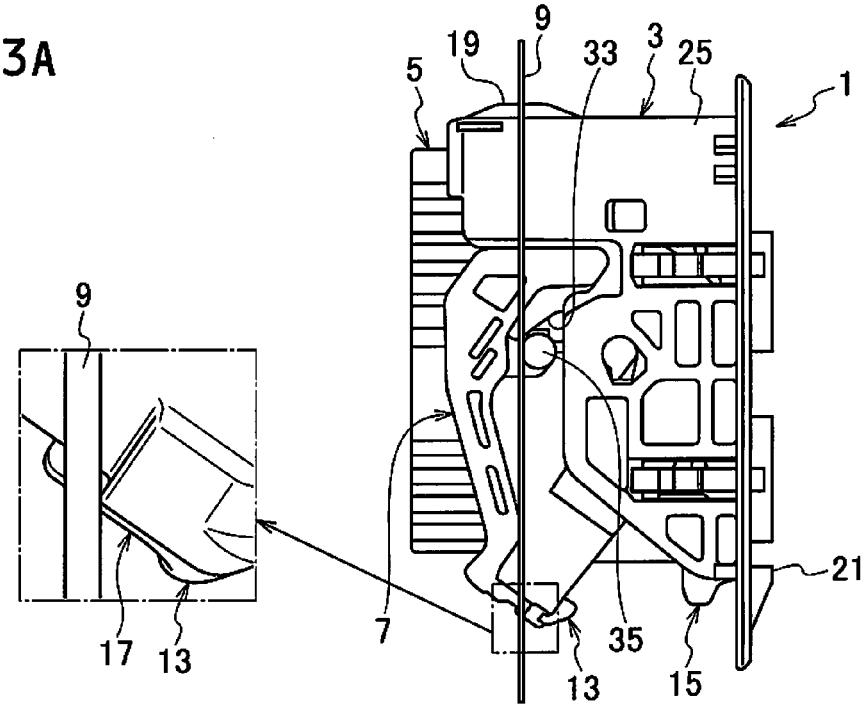
FIG. 3A is a side view of the lever connector according to the exemplary embodiment of the present invention when a first connector and a second connector have a partial locked state.
Figure 3B:
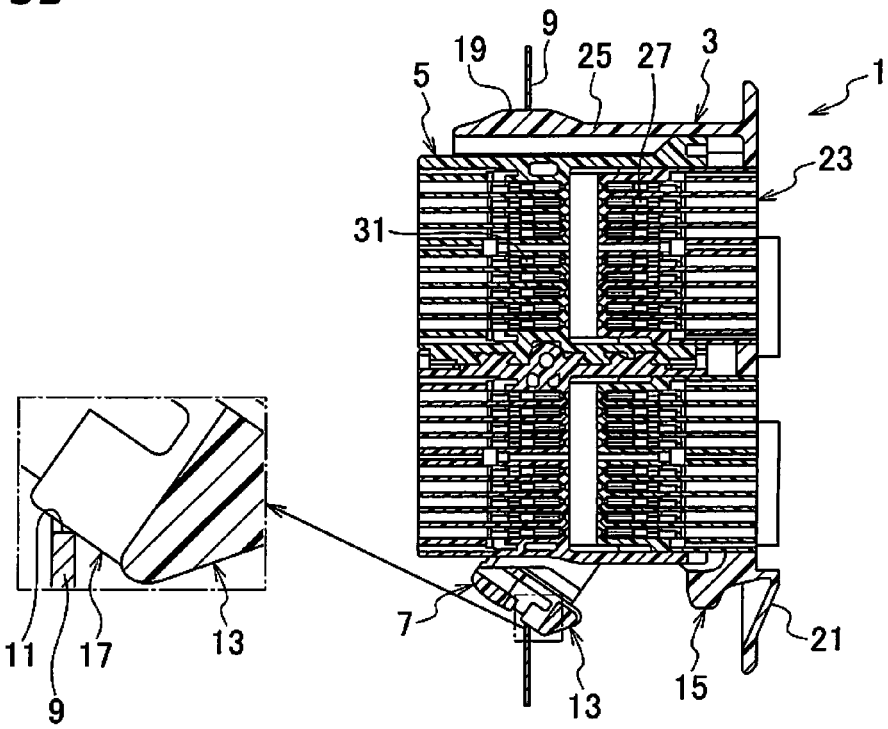
FIG. 3B is a cross-sectional view of the lever connector illustrated in FIG. 3A.

As shown in FIGS. 3A and 3B, in a case where the first connector 3 and the second connector 5 have the partial locked state when the cam followers 35 of the second connector 5 are inserted in the cam grooves 33 of the lever 7 in order to attach the lever connector 1 to the panel 9, the abutment portion 17 abuts on a lower edge part of the attachment hole 11 of the panel 9, and the abutment enhancement portion 19 abuts on an upper edge part of the attachment hole 11. The abutment makes it possible to detect the partial fitted state of the first connector 3 and the second connector 5.

Figure 4A:
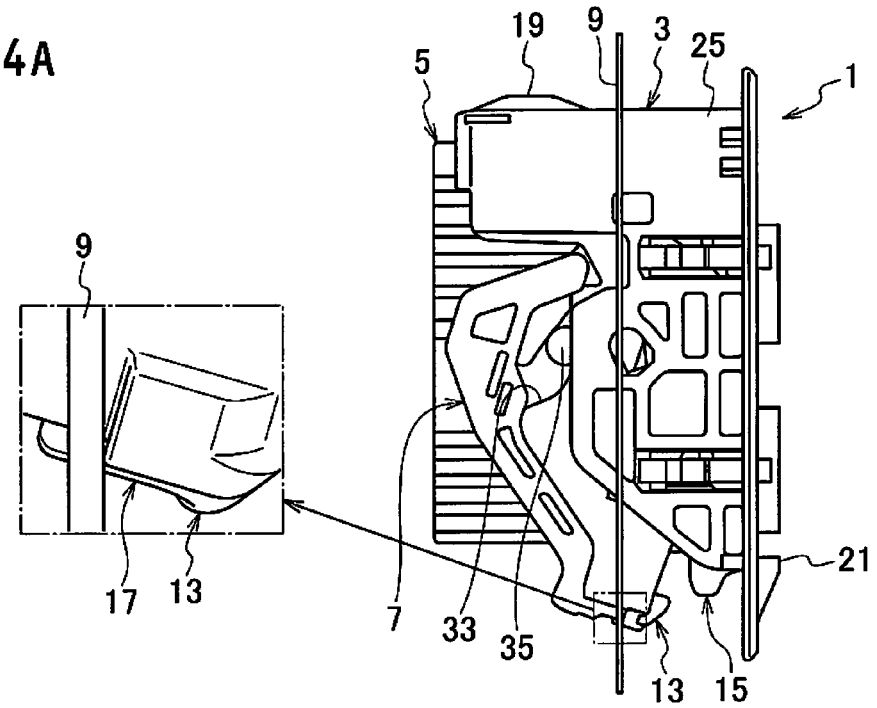
FIG. 4A is a side view of the lever connector according to the exemplary embodiment of the present invention when the first connector and the second connector have a partial locking released state.
Figure 4B:
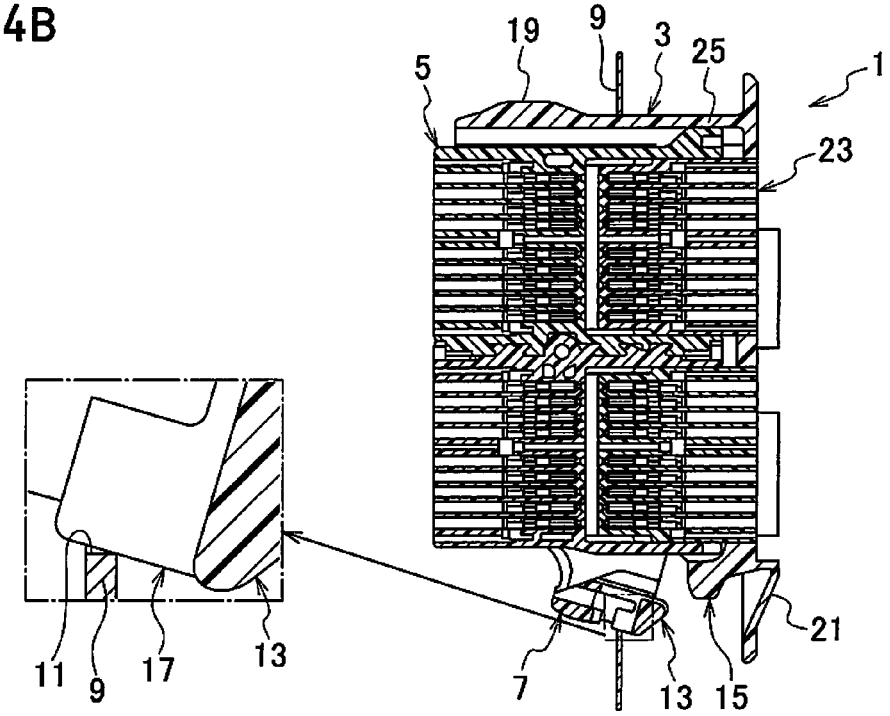
FIG. 4B is a cross-sectional view of the lever connector illustrated in FIG. 4A.

Further, as shown in FIGS. 4A and 4B, in a case where the first connector 3 and the second connector 5 have a partial locking released state when the rotation of the lever 7 is started from the partial locked state in order to attach the lever connector 1 to the panel 9, although the abutment of the abutment enhancement portion 19 is avoided, the abutment portion 17 abuts on the lower edge part of the attachment hole 11 of the panel 9. The abutment makes it possible to detect the partial fitted state of the first connector 3 and the second connector 5.

Figure 5A:
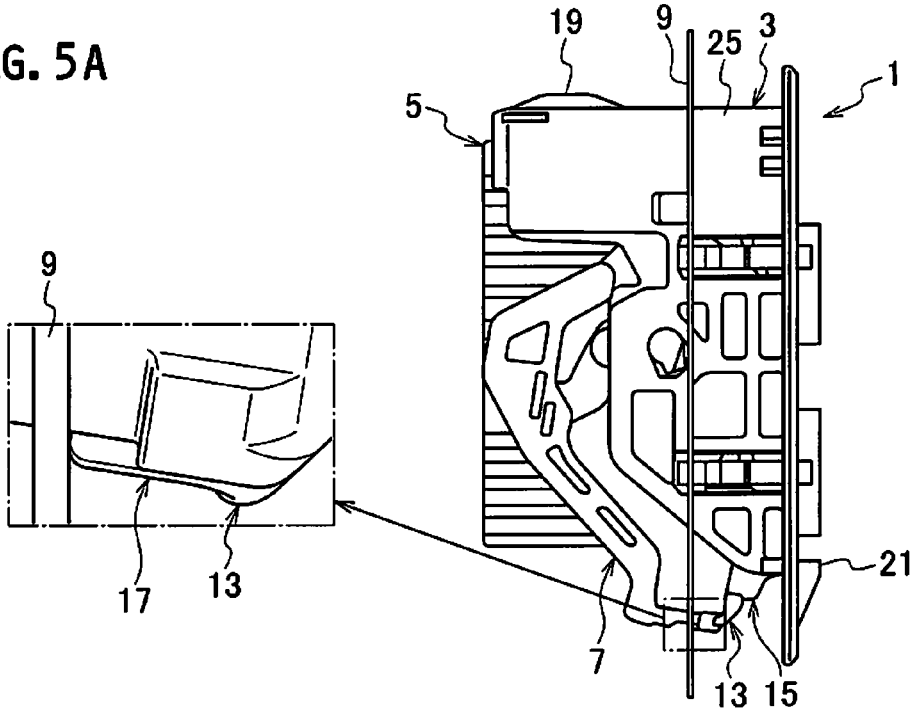
FIG. 5A is a side view of the lever connector according to the exemplary embodiment of the present invention in a state prior to a normal fitting of the first connector and the second connector.
Figure 5B:
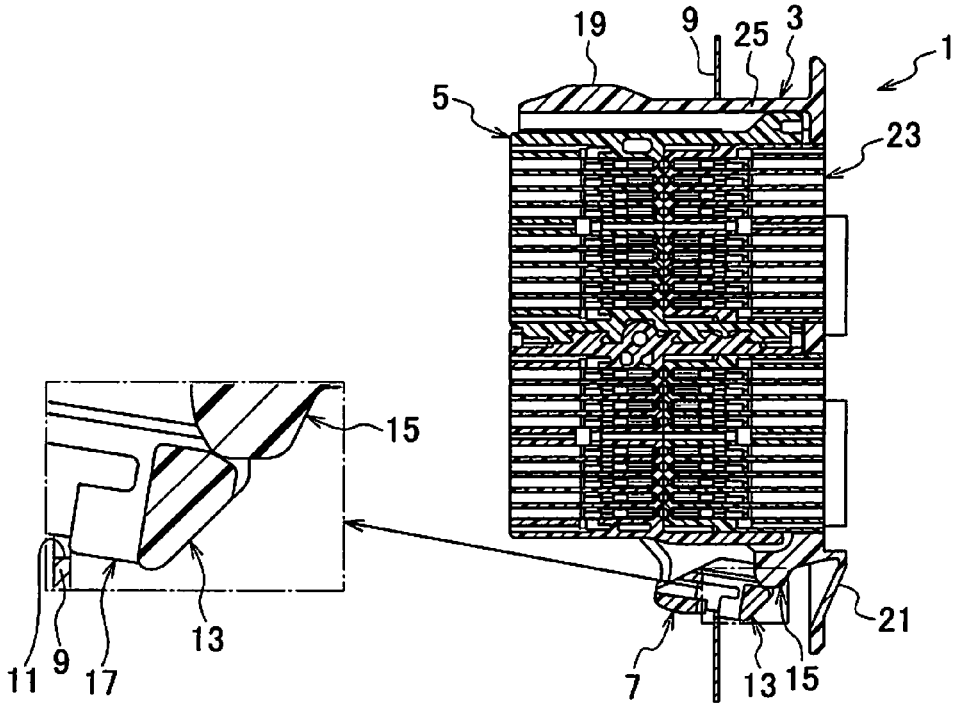
FIG. 5B is a cross-sectional view of the lever connector illustrated in FIG. 5A.

Moreover, as shown in FIGS. 5A and 5B, in a case where the lever 7 approaches a horizontal direction with respect to the fitted direction of the first connector 3 and the second connector 5 to bend the locking portion 13 of the lever 7 by the locked portion 15 of the frame 25 in the outward direction with respect to the rotation direction of the lever 7 in order to attach the lever connector 1 to the panel 9, the abutment portion 17 has its rear edge side in the attachment direction to the panel 9 protruding in the outward direction from the lower edge part of the attachment hole 11. If the attachment of the lever connector 1 to the panel 9 is continued in this state, the abutment portion 17 abuts on the lower edge part of the attachment hole 11 of the panel 9. The abutment makes it possible to detect the partial fitted state of the first connector 3 and the second connector 5.

Figure 6A:
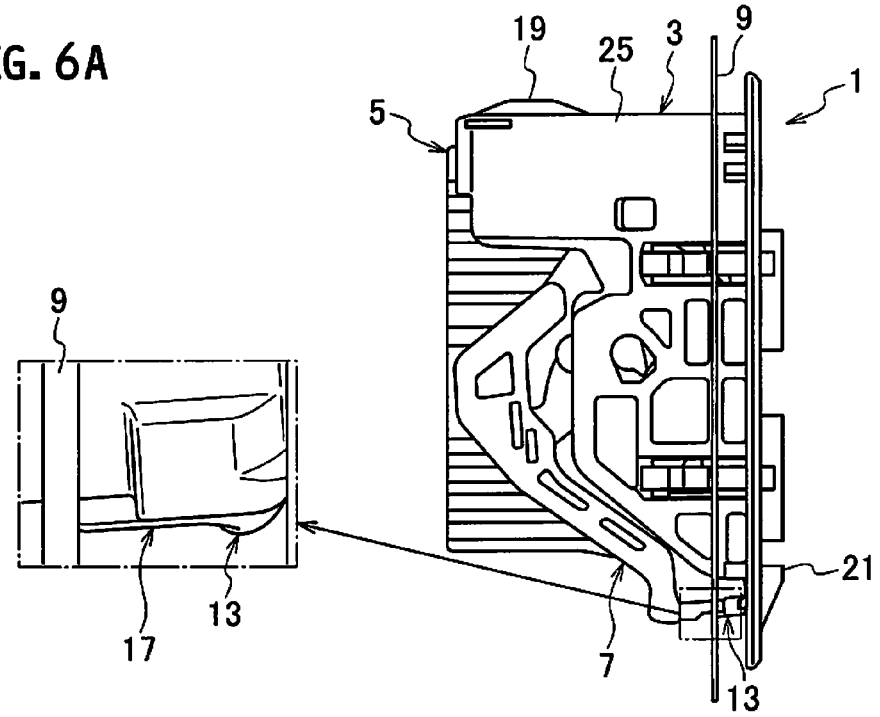
FIG. 6A is a side view of the lever connector according to the exemplary embodiment of the present invention when the first connector and the second connector have a normal fitted state.
Figure 6B:
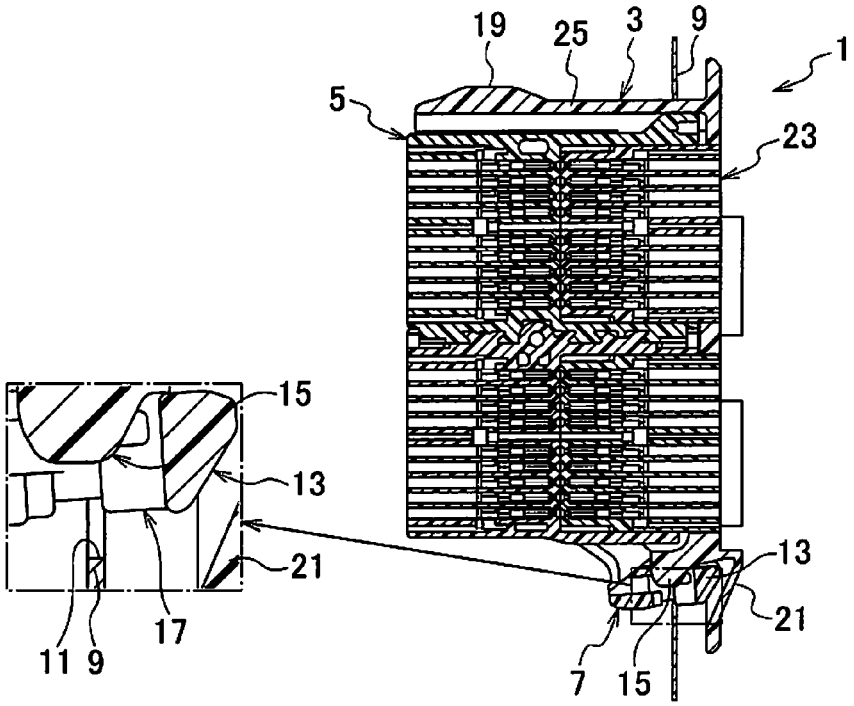
FIG. 6B is a cross-sectional view of the lever connector illustrated in FIG. 6A.

Moreover, as shown in FIGS. 6A and 6B, in a case where the first connector 3 and the second connector 5 have the normal fitted state when the rotation of the lever 7 is normally completed in order to attach the lever connector 1 to the panel 9, the locking portion 13 gets over the locked portion 15 and is restored in the inward direction with respect to the rotation direction of the lever 7. This avoids the abutment of the abutment portion 17 on the lower edge part of the attachment hole 11 of the panel 9. Then, the plurality of panel locks 29 of the frame 25 is locked with the attachment hole 11 of the panel 9. Thereby, the lever connector 1 in which the first connector 3 and the second connector 5 have the normal fitted state, is attached to the panel 9.

Incidentally, in the case of the partial fitted state of the first connector 3 and the second connector 5 as shown in FIGS. 9A, 4B, 5A, and 5B, it is considered that the abutment portion 17 is prevented from abutting on the lower edge part of the attachment hole 11 by displacing the lever connector 1 toward the upper side of the attachment hole 11. However, in this case, since the abutment enhancement portion 19 abuts on the upper edge part of the attachment hole 11, it is possible to detect the partial fitted state of the first connector 3 and the second connector 5.

In the lever connector 1, the lever 7 includes the locking portion 13 which is provided to be bendable in the inward direction and the outward direction with respect to the rotation direction of the lever 7, and the first connector 3 includes the locked portion 15 that is to be locked with the locking portion 13, wherein the rotation of the lever 7 causes the locking portion 13 to be bent in the outward direction with respect to the rotation direction of the lever 7, and then causes the locking portion 13 to be bent in the inward direction with respect to the rotation direction of the lever 7 in the normal fitted state of the first connector 3 and the second connector 5 such that the locked portion 15 is locked with the locking portion 13. Thereby, a portion which extends in the outward direction with respect to the rotation direction of the lever 7 in the partial fitted state of the connectors 3 and 5 is only the locking portion 13 which is bent by the locked portion 15. Thus, it is possible to prevent increase in the size of the lever connector 1.

The locking portion 13 is provided with the abutment portion 17 which abuts on the edge part of the attachment hole 11 when the first connector 3 and the second connector 5 are attached to the attachment hole 11 of the panel 9 in the middle of the rotation of the lever 7. The locking portion 13 is not bent in the inward direction with respect to the rotation direction of the lever 7 until the connectors 3 and 5 are brought into the normal fitted state. Thereby, the abutment portion 17 of the locking portion 13 which is bent in the outward direction with respect to the rotation direction of the lever 7 abuts on the edge part of the attachment hole 11 even though the lever 7 approaches the horizontal direction with respect to the fitting direction of the connectors 3 and 5. Thus, it is possible to detect the partial fitted state of the connectors 3 and 5.

Therefore, in the lever connector 1, it is possible to improve detection of the partial fitted state of the connectors 3 and 5 while suppressing the increase of the size thereof.

The first connector 3 is provided with the abutment enhancement portion 19 which abuts on the edge part of the attachment hole 11 when the abutment portion 17 abuts on the edge part of the attachment hole 11. Thereby, in addition to the detection of the partial fitted state of the connectors 3 and 5 by the abutment portion 17, it is possible to detect the partial fitted state of the connectors 3 and 5 by the abutment of the abutment enhancement portion 19 on the edge part of the attachment hole 11. Thus, it is possible to further improve the detection of the partial fitted state of the connectors 3 and 5.

The first connector 3 is further provided with the regulation portion 21 which regulates the bending of the locking portion 13 in the outward direction with respect to the rotation direction of the lever 7 in the normal fitted state of the first connector 3 and the second connector 5. Since the regulation portion 21 prevents release of the locking of the locking portion 13 and the locked portion 15, it is possible to keep the normal fitted state of the connectors 3 and 5.

Although the lever connector according to the exemplary embodiment of the present invention has a structure in which the lever is provided on the first connector, it may have a structure in which the lever is provided on the second connector.

Although the separate inner housing and the separate frame are formed and then integrally assembled as the first connector, an inner housing and a frame may be integrally formed.

What is claimed is:

1. A lever connector to be attached to an attachment hole of a panel, comprising:

a first connector;

a second connector to be fitted with the first connector; and a lever that is provided to one of the first connector and the second connector and causes the first connector and the second connector to be fitted with each other by rotation thereof, wherein the lever connector is attached to the attachment hole of the panel in a state where the first connector and the second connector are fitted with each other, the lever includes a locking portion that is provided to be bendable inward and outward with respect to a rotation direction of the lever, the one of the first connector and the second connector includes a locked portion that is to be locked with the locking portion, wherein the rotation of the lever causes the locking portion to be bent outward with respect to the rotation direction of the lever in a half fitting state of the first connector and the second connector to get over the locked portion, and then causes the locking portion to be bent inward with respect to the rotation direction of the lever in a normal fitted state of the first connector and the second connector such that the locked portion is locked with the locking portion, and the locking portion is provided with an abutment portion that abuts on an edge part of the attachment hole when the first connector and the second connector are attached to the attachment hole of the panel in the half fitting state where the locking portion is bent outward.

2. The lever connector according to claim 1, wherein the one of the first connector and the second connector is provided with an abutment enhancement portion that abuts on the edge part of the attachment hole when the abutment portion abuts on the edge part of the attachment hole.

3. The lever connector according to claim 1, wherein the one of the first connector and the second connector is provided with a regulation portion that regulates bending of the locking portion outward with respect to the rotation direction of the lever in the normal fitted state of the first connector and the second connector.

* * * * *